US009166329B2

(12) United States Patent
Eckel et al.

(10) Patent No.: US 9,166,329 B2
(45) Date of Patent: Oct. 20, 2015

(54) ELECTRICAL CONNECTOR AND CONNECTOR SYSTEM

(75) Inventors: Markus Eckel, Buerstadt (DE); Ulf Hoeppner, Bammental (DE); Walter Saenger, Fuerth (DE)

(73) Assignee: Tyco Electronics AMP GmbH, Bensheim (DE)

( * ) Notice: Subject to any disclaimer, the term of this patent is extended or adjusted under 35 U.S.C. 154(b) by 42 days.

(21) Appl. No.: 13/985,641

(22) PCT Filed: Feb. 7, 2012

(86) PCT No.: PCT/EP2012/052047

§ 371 (c)(1),
(2), (4) Date: Aug. 15, 2013

(87) PCT Pub. No.: WO2012/110361

PCT Pub. Date: Aug. 23, 2012

(65) Prior Publication Data

US 2013/0323954 A1 Dec. 5, 2013

(30) Foreign Application Priority Data

Feb. 17, 2011 (DE) ..... 10 2011 004 347

(51) Int. Cl.

| | |
|---|---|
| ***H01R 13/52*** | (2006.01) |
| ***H01R 13/533*** | (2006.01) |
| *H01R 13/629* | (2006.01) |
| *H01R 13/641* | (2006.01) |
| *H01R 13/703* | (2006.01) |
| *H01R 103/00* | (2006.01) |

(52) U.S. Cl.

CPC ..... *H01R 13/5205* (2013.01); *H01R 13/5219* (2013.01); *H01R 13/533* (2013.01); *H01R 13/5202* (2013.01); *H01R 13/62938* (2013.01); *H01R 13/641* (2013.01); *H01R 13/7032* (2013.01); *H01R 2103/00* (2013.01); *H01R 2201/26* (2013.01)

(58) Field of Classification Search

CPC ..... H01R 13/5205; H01R 13/5219; H01R 13/5202; H01R 13/5208

USPC ..... 439/271, 275

See application file for complete search history.

(56) References Cited

U.S. PATENT DOCUMENTS

| | | | | |
|---|---|---|---|---|
| 5,865,636 | A | 2/1999 | Myer et al. | |
| 6,910,905 | B2 * | 6/2005 | Tanaka et al. | 439/271 |
| 2006/0094275 | A1 * | 5/2006 | Fukatsu et al. | 439/275 |
| 2009/0042438 | A1 * | 2/2009 | Iwahori et al. | 439/521 |

FOREIGN PATENT DOCUMENTS

| | | | |
|---|---|---|---|
| EP | 1770829 | A1 | 4/2007 |
| WO | WO-2008/109109 | A1 | 9/2008 |

OTHER PUBLICATIONS

Chelbosu, Liviu, "International Search Report" for PCT/EP2012/052047, as mailed May 4, 2012, 4 pages.

* cited by examiner

*Primary Examiner* — Gary Paumen
(74) *Attorney, Agent, or Firm* — Barley Snyder

(57) ABSTRACT

The invention relates to an electrical connector (100) for producing a plug-in connection with a mating connector (200). The electrical connector (100) has a housing (110), a seal (160) arranged on the housing (110), and a seal holder (170) arranged on the housing (110) and associated with the seal (160). The seal holder (170) is arranged movably on the housing (110), in order to be moved in the direction of the seal (160) upon the production of the plug-in connection with the mating connector (200) and to be pressed against the seal (160). The invention furthermore relates to a connector system comprising such an electrical connector (100) and a mating connector (200) which can be plugged with the electrical connector (100).

12 Claims, 8 Drawing Sheets

ELECTRICAL CONNECTOR AND CONNECTOR SYSTEM

The present invention relates to an electrical connector for producing a plug-in connection with a mating connector. The invention furthermore relates to a connector system comprising such an electrical connector, and to a mating connector which can be plugged into the electrical connector.

Connector systems for producing and disconnecting electrical connections are known in various configurations. The connector systems, with the aid of which for example a line can be connected to another device, as a rule comprise an electrical connector, also referred to as a plug-in connector, and an associated mating connector which can be plugged into the connector. The connector and mating connector are provided with corresponding contact elements, via which an electrical connection can be produced. The contact elements may be in the form of male and female contact elements, which are also referred to as contact pins or "pins" and female contacts, respectively.

A conventional high-voltage connector system used in the automotive sector comprises a plug-in connector which is provided with female contacts and to which high-voltage lines can be connected, and an associated plug-in connector mating part in the form of a pin connector with contact pins. The plug-in connector has a housing, a circumambient seal arranged on or within the housing with an L-shaped cross-sectional profile, and a seal holder fastened to or within the housing and associated with the seal. The seal holder serves to support the seal and to fix it to the housing. The housing furthermore has a cable outlet of 180°, i.e. a line connected to the plug-in connector in the region of the plug-in connector extends in a direction which coincides with a direction of plugging of the plug-in connector.

The associated mating connector or the pin connector is provided with a flat, collar-shaped section ("pin-connector collar") which encompasses the contact pins. Upon the connection operation between the plug-in connector and the pin connector, the collar of the pin connector is received in the housing of the plug-in connector. The pin-connector collar in such case presses against the seal of the plug-in connector, which seals off the plug-in connection between the connector and pin connector, at this point. Furthermore, also an elastic stop of the plug-in connector in the direction of plugging is permitted by means of the seal which is "pre-tensioned" with the aid of the pin-connector collar. This means that a play of the plug-in connector on the pin connector can be reduced or eliminated, which makes the plug-in connection less sensitive to mechanical influences such as in particular vibrations.

In an alternative embodiment of the plug-in connector, a cable outlet of 90° is provided, i.e. a line connected to the plug-in connector in the region of the plug-in connector extends at a right angle to a direction of plugging of the plug-in connector. With regard to the associated mating connector, with such a configuration it may further be considered to provide a stepped collar instead of a flat pin-connector collar, which means that a small space requirement of the plug-in connector placed on the mating connector can be obtained. What is disadvantageous is however that with such a configuration of the connector system an elastic stop of the plug-in connector cannot be realised, or can be realised only with very great difficulty with the aid of an L-shaped "standard seal".

The object of the invention is to devise an improved solution for an elastic stop of an electrical connector which can be plugged with an associated mating connector.

This object is achieved by an electrical connector according to claim 1 and by a connector system according to claim 10. Further advantageous embodiments of the invention are set forth in the dependent claims.

According to the invention, an electrical connector for producing a plug-in connection with a mating connector is proposed. The electrical connector has a housing, a seal arranged on the housing, and a seal holder arranged on the housing and associated with the seal. The seal holder is arranged movably on the housing, in order to be moved in the direction of the seal upon producing the plug-in connection with the mating connector and to be pressed against the seal.

In the electrical connector, a movable seal holder is provided instead of a securely fixed or unmovable seal holder. Upon producing the plug-in connection between the connector and mating connector, the movable seal holder can be pressed against the mating connector (via the seal). The result of this is that the seal holder upon the connection operation is moved in the direction of the seal and is pressed against the seal, which compresses or squeezes the seal. This realises, in a simple and reliable manner, an elastic stop of the electrical connector in the direction of plugging. Owing to the elastic stop, a manufacturing-related play of the electrical connector on the mating connector can be reduced or eliminated, which means that the plug-in connection is (less) sensitive to mechanical influences such as in particular vibrations.

The elastic stopping of the electrical connector can take place in particular independently of a collar structure optionally provided on the mating connector. This provides the possibility of providing a form which differs from a flat form for such a collar of the mating connector.

In a preferred embodiment, the seal holder is arranged displaceably on the housing. Such mobility of the seal holder can be realised in relatively simple manner.

In a further preferred embodiment, the seal holder has (at least) one latch element which engages in a cutout of the housing. This means that detachment of the movable seal holder from the housing of the (non-plugged) electrical connector can be reliably prevented. The dimensions of the cutout of the housing in such case are selected such that the latch element has corresponding freedom of movement for permitting the movement of the seal holder.

In a further preferred embodiment, the seal holder has a short-circuit bridge which upon the production of the plug-in connection with the mating connector can be contacted by the mating connector. With the aid of the short-circuit bridge, it can be checked reliably whether the electrical connector is placed on the mating connector or not.

The seal of the electrical connector preferably has a closed circumambient form. Also, the encompassing seal is arranged on a collar-shaped wall section of the housing. This means that reliable sealing of the plug-in connection between the connector and mating connector can be achieved with the aid of the seal.

In a further preferred embodiment, the seal of the electrical connector has an L-shaped cross-sectional profile with a first seal section and a second seal section extending perpendicular to the first seal section. In this respect, the seal may be a "standard seal" which is inexpensive to produce.

In a further preferred embodiment, provision is made for the first seal section of the seal to encompass a collar-shaped wall section of the housing on its periphery, and for the second seal section of the seal to be in the form of an inward-directed flange. The seal holder is arranged movably on the housing such that the second seal section of the seal upon a movement of the seal holder can be pressed against a front side of the collar-shaped wall section of the housing. With such a configuration, the elastic stop of the electrical connector can occur substantially via compression or pressing of the second flange-shaped sealing section against the front side of the collar-shaped wall section. The other (i.e. first) seal section of the seal on the other hand can be used for sealing off the plug-in connection between the connector and mating connector. This division means that the seal can reliably "fulfill" its intended functions (elastic stop, sealing).

In a further preferred embodiment, the electrical connector further has a contact element for producing an electrical connection with a complementary contact element of the mating connector, and a connection element which is separate from the contact element and connected to the contact element for producing an electrical connection to a line. Such a two-piece configuration offers the possibility of (electrically) connecting the line in a simple manner to the contact element of the electrical connector. This applies in particular to configurations of the connector in which there is no cable outlet of 180°, but an "angled" cable outlet.

This covers a further preferred embodiment in which the electrical connector is formed such that in the case of a line connected to the electrical connector a section of the line in the region of the electrical connector extends at a right-angle to a direction of plugging of the electrical connector. Such a configuration with a cable outlet of 90° permits a low space requirement for the plug-in connection.

According to the invention, furthermore a connector system is proposed which comprises an electrical connector according to one of the embodiments described above and a mating connector which can be plugged with the electrical connector. In such case, the seal and the seal holder which is mounted movably on top of or on the housing of the electrical connector and can be pressed against the seal ensure in simple and reliable manner an elastic stop of the electrical connector, which means that the plug-in connection is robust with respect to mechanical influences such as in particular vibrations.

In a preferred embodiment of the connector system, the mating connector has a collar-shaped section which can be received in the housing of the electrical connector. The seal of the electrical connector is arranged on the housing of the electrical connector such that the collar-shaped section of the mating connector in the state received in the housing of the electrical connector encompasses the seal of the electrical connector and is in physical contact with the seal. Such cooperation of the collar-shaped section of the mating connector with the seal of the electrical connector means that reliable sealing of the plug-in connection can be achieved. Since the elastic stop of the electrical connector is effected via the seal and the movable seal holder, a form which differs from a flat form can be provided for the collar-shaped section of the mating connector.

This is for example the case in a further preferred embodiment according to which the collar-shaped section of the mating connector comprises two partial sections of different heights. Such a stepped configuration may be considered in particular with regard to a configuration of the electrical connector with a cable outlet of 90°, and permits a low space requirement of the plug-in connection which is produced via the connector and mating connector. This is advantageous in applications in which merely a small installation space is available.

The invention will be explained in greater detail below with reference to the figures. Therein:

A possible configuration of a connector system comprising an electrical connector 100 and an associated mating connector 200 is described with reference to the following figures. The connector system may be in particular a high-voltage (HV) connector system which can be used in hybrid, battery and/or fuel-cell vehicles, with the aid of which high-voltage lines 300 can be connected electrically to devices such as for example batteries, electric motors, etc. The connector 100 and the mating connector 200 may have external dimensions which are for example in the centimeter range. Also the connector system may be formed with regard to Standard AK 215-1 of the German OEMs ("Original Equipment Manufacturers").

Figure 1:
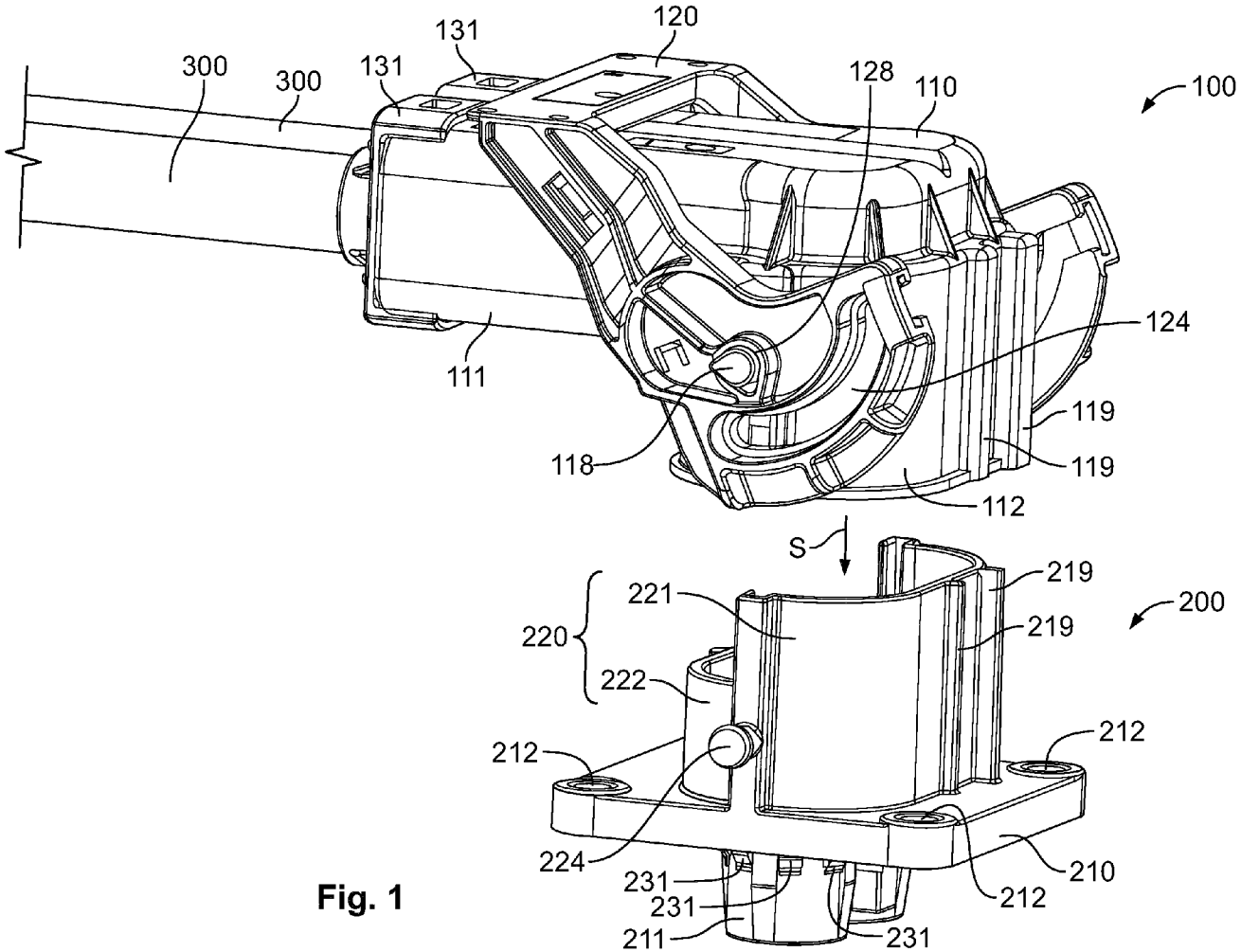
FIG. 1 shows a perspective view of a connector system comprising an electrical connector and a mating connector in the non-plugged state.

FIG. 1 shows a perspective view of the electrical connector 100 and the mating connector 200 which can be plugged with the connector 100, in the non-plugged state. Further, two lines 300 used for the transmission of electrical energy are connected to the electrical connector 100, which will also be referred to below as "plug-in connector 100" or "HV plug-in connector 100", as indicated in FIG. 1.

The plug-in connector 100 has a housing 110 made from a plastics material. The housing 110, viewed from the side, has a substantially L-shaped shape with a housing section 111 and a further housing section 112 extending perpendicular thereto. The lines 300 or the line ends thereof are received in the housing section 111. In such case, the housing section 111 may have (two) chambers associated with the individual lines 300 (not shown).

The adjoining other housing section 112 of the housing 110 is intended to be placed on the mating connector 200 upon the connection operation of the connector 100 and mating connector 200. In so doing, the plug-in connector 100 is moved in the direction of the mating connector 200 in a direction of plugging S indicated in FIG. 1 by means of an arrow, which means that part of the mating connector 200 can be received in the housing section 112 (see FIG. 2). For this, the side of the housing section 112 via which the mating connector 200 is (partially) received, and which is also referred to below as "insertion side", is partially open or freely accessible (see FIG. 7).

The connector 100 and the mating connector 200 have contact elements 150, 250 which are formed to be complementary to each other, which elements upon the connection operation can be plugged together and electrically contacted to each other. In the connector system shown, the plug-in connector 100 is provided with (two) metallic female contacts 150 (see FIG. 3), and the mating connector 200 with (two) corresponding metallic contact pins 250 which can be inserted into the female contacts 150 (see FIG. 4). This will be discussed in greater detail further below.

Figure 2:
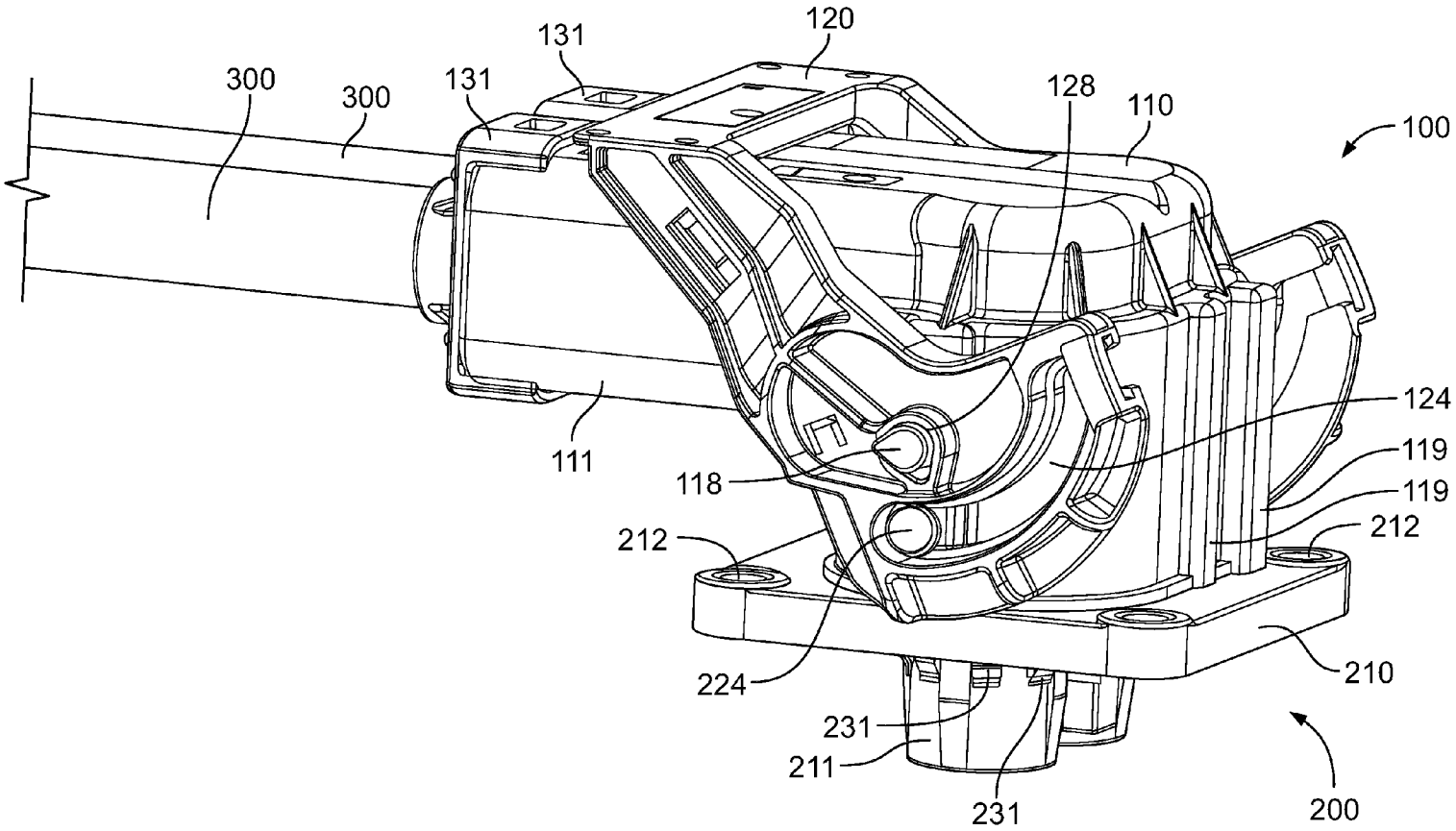
FIG. 2 shows a further perspective view of the connector system in the plugged state of the connector and mating connector.

As becomes obvious with reference to FIGS. 1 and 2, the lines 300 connected to the plug-in connector 100 in the region of the plug-in connector 100 extend at right-angles to the direction of plugging S which exists when plugging the plug-in connector 100 on to the mating connector 200. Such a configuration of the plug-in connector 100 or of the L-shaped housing 110 thereof with a cable outlet of 90° results in the plug-in connector 100 which is placed on the mating connector 200 taking up a relatively small amount of space ("90° interface"). This is advantageous with regard to (constricted) space conditions in the region of the plug-in connection between the plug-in connector 100 and mating connector 200 which is to be produced.

The plug-in connector 100 or the housing 110 thereof is furthermore, as is illustrated in FIGS. 1 and 2, provided with a pivotably mounted locking lever or locking stirrup 120. This serves to facilitate the placing of the plug-in connector 100 on to the mating connector 200, and to lock the plug-in connector 100 placed on the mating connector 200. The locking stirrup 120 has a substantially U-shaped form, which partially engages around the housing 110 of the plug-in connector 100, with a central actuating section which can be actuated by a user and two locking sections extending laterally therefrom. For the pivotable mounting of the locking stirrup 120 on the housing 110, the locking sections of the locking stirrup 120 are provided with corresponding cutouts 128, in which raised sections 118 arranged on both sides on the housing 110 engage. Furthermore, the locking stirrup 120 has arcuate or slotted-link-shaped holes 124 on the locking sections, which holes are open to one side and are formed with regard to raised sections 224 arranged on the mating connector 200.

For the connection operation of the connector 100 and mating connector 200, the locking stirrup 120, in a departure from the position shown in FIGS. 1 and 2, which it is a locking position, is brought into a tilted unlocking position (not shown). The plug-in connector 100 is further placed on the mating connector 200 such that the holes 124 of the locking stirrup 120 can engage the raised sections 224 of the mating connector 200. By subsequent actuation and pivoting of the locking stirrup 120 out of the unlocking position into the locking position, the plug-in connector 100, owing to the holes 124 which cooperate with the raised sections 224 (in the direction of plugging S), can be drawn towards the mating connector 200 and fixed thereto. This "plugged state" is shown in FIG. 2. To release this fixing, the locking stirrup 120 can be pivoted out of the locking position into the unlocking position, which moves the plug-in connector 100 away from the mating connector 200 (counter to the direction of plugging S) and releases the raised sections 224 (again).

The mating connector 200 is in the form of a pin connector with contact pins 250 associated with the female contacts 150 of the plug-in connector 100. In such case, the mating connector 200, as is illustrated in FIGS. 1 and 2, has a plate-shaped or pedestal-shaped base part 210 which is rectangular in a top view, with hollow-cylindrical or circular-cylindrical holding sections 211 formed thereon for the contact pins 250 (see also FIGS. 4 and 7). The holding sections 211 are brought out on an underside of the base part 210 or extend downwards beyond the underside of the base part 210.

Furthermore, as is illustrated in FIG. 1, a collar-shaped wall 220 with a closed circumambient form is formed on an upper side of the base part 210 of the mating connector 200. The collar-shaped section 220, which will also be referred to below as collar 220 ("pin-connector collar", "connection collar"), encompasses the contact pins 250 and further components of the mating connector 200 (see also FIGS. 4 and 8). Upon the connection operation of the connector 100 and mating connector 200, the collar 220, as is clear with reference to FIG. 2, is received in the housing 110 or housing section 112 of the plug-in connector 100. In so doing, the collar 220 may come into physical contact with a circumambient seal 160 of the plug-in connector 100 which is arranged in the housing 110 or housing section 112, which means that the plug-in connection produced via the connector 100 and mating connector 200 is sealed at this point (see FIG. 5). This will be discussed in greater detail further below.

The pin-connector collar 200 of the mating connector 200, as is shown in FIG. 1, is divided into two partial sections 221, 222 of different heights. This stepped form of the collar 220 is selected with a cable outlet of 90° with regard to the configuration of the plug-in connector 100, which further benefits a low space requirement of the plug-in connection which is produced via the connector 100 and mating connector 200.

As is furthermore illustrated in FIG. 1, two ribs 219 are formed on to an outer side of the higher collar section 221 of the collar 220. Corresponding to this, the housing 110 or the housing section 112 of the plug-in connector 100 has groove-shaped receiving regions 119 in which the ribs 219 can be received. The ribs 219 and receiving regions 119 may supply (additional) guidance when plugging the connector 100 and mating connector 200, which facilitates the connection operation.

Also the raised sections 224 of the mating connector 200 which are matched to the locking stirrup 120, as is illustrated in FIG. 1, are arranged on the higher collar section 221, in regions adjoining the lower collar section 222. At these points, the collar section 221 further has partial sections which (in a top view) extend in a U-shape, which partial sections can ensure reinforcement of the collar 220 with regard to the locking carried out with the locking stirrup 120.

With the mating connector 200, the base part 210 and the sections formed thereon (collar 220, holding sections 211) are made from a plastics material. The base part 210 furthermore, as illustrated in FIGS. 1 and 2, is provided with cutouts 212 on the (rounded-off) corners. This provides the possibility of fastening the mating connector 200 or the base part 210 thereof to other devices with the aid of screws. In order to prevent damage to the (plastics-material) base part 210 or in order to reinforce the cutouts 212 in so doing, metal spacer sleeves may be arranged in the cutouts 212.

Figure 3:
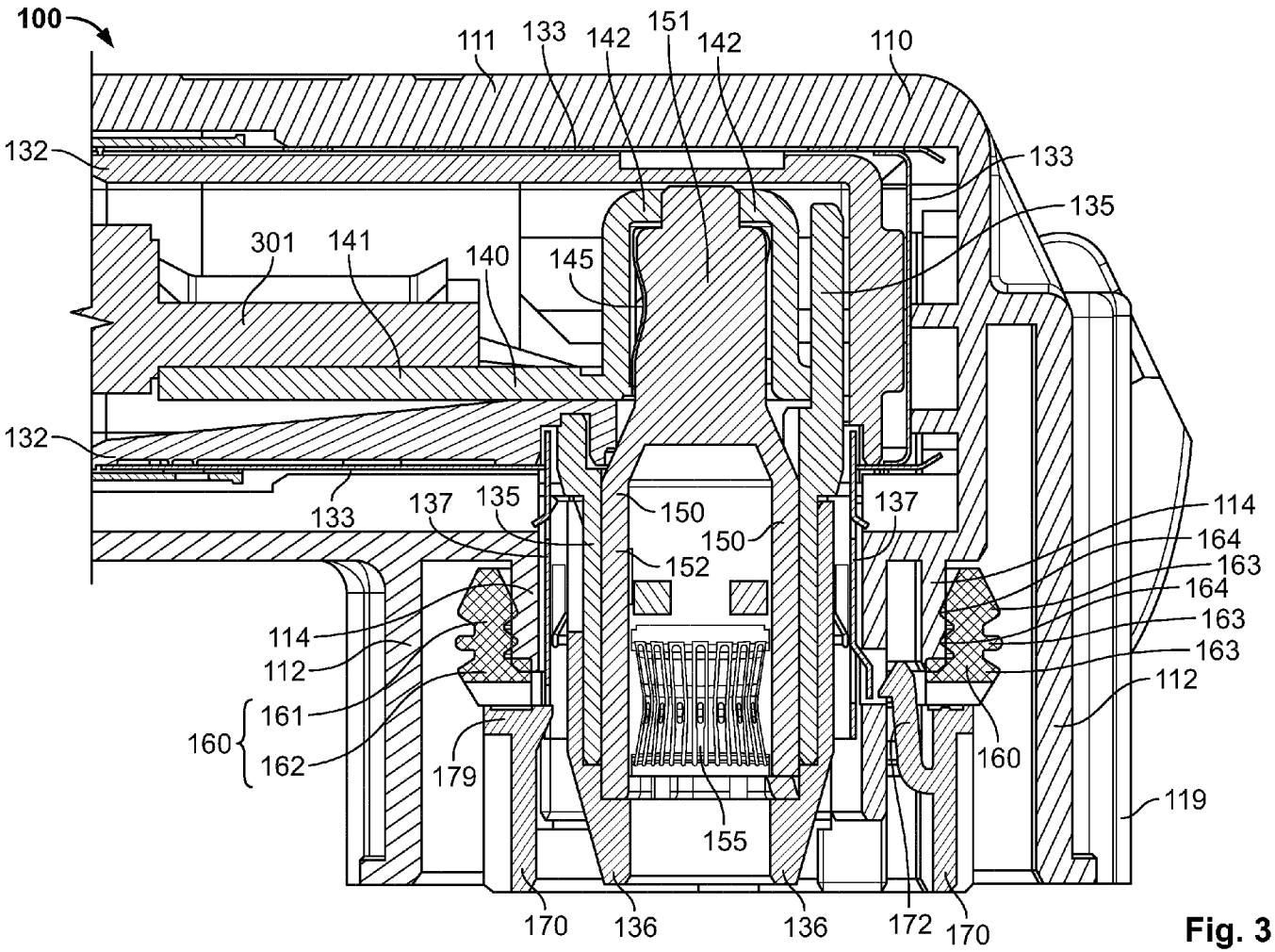
FIG. 3 shows a sectional view of a partial region of the electrical connector.

FIG. 3 shows a sectional view of a partial region of the plug-in connector 100, by means of which the internal construction of the plug-in connector 100 becomes clear. The plug-in connector 100 has within the housing 110 two substantially hollow-cylindrical or circular-cylindrical female contacts 150 arranged next to one another, of which merely one female contact 150 is shown in cross-section in FIG. 3. The two female contacts 150, which are constructed from a metallic material, are connected in each case to a core 301 (formed for example in the form of stranded cables) of one of the two lines 300.

Figure 5:
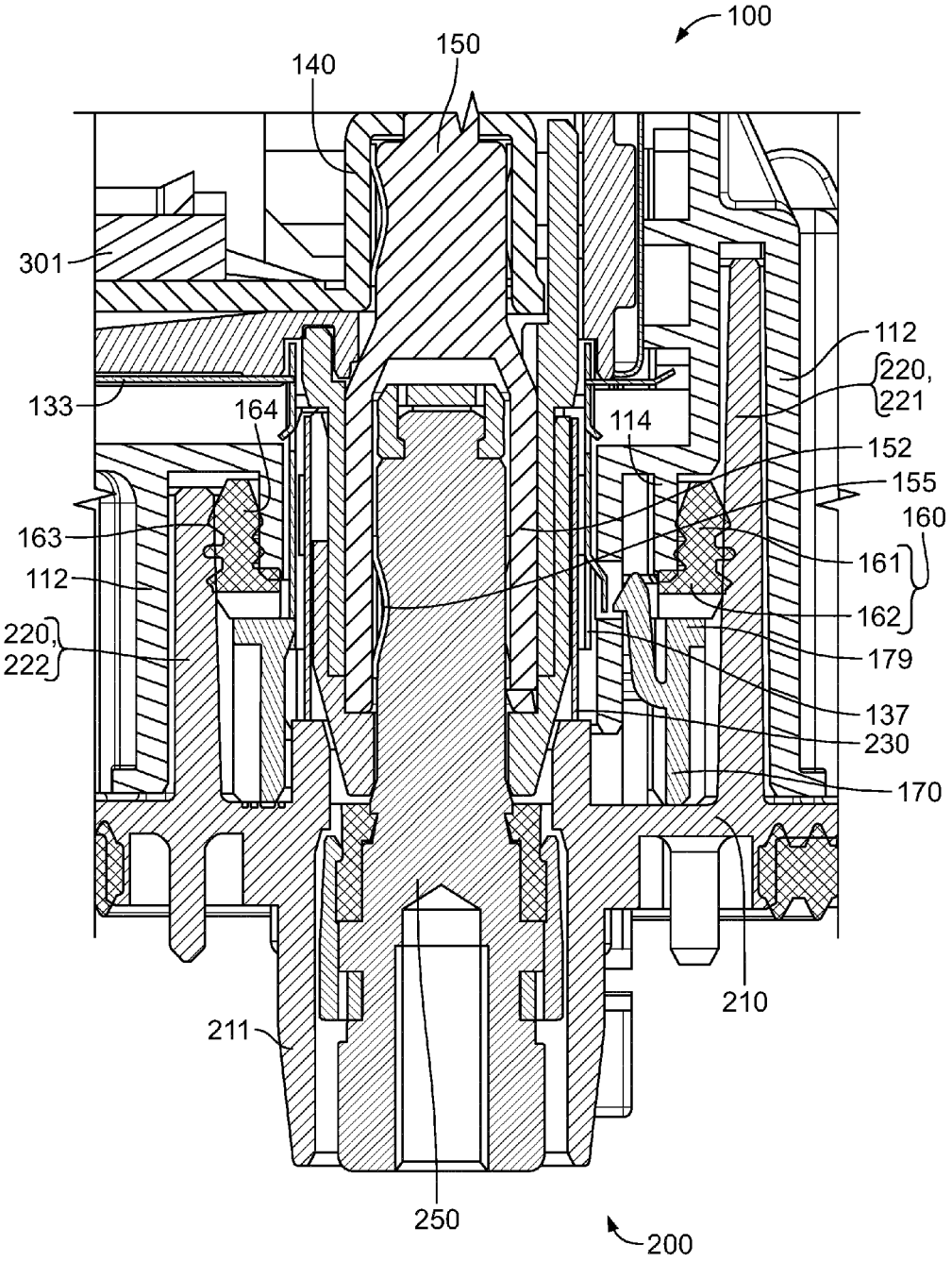
FIG. 5 shows a sectional view of a partial region of the connector and mating connector in the plugged state.

The female contacts 150 have in each case a stepped upper (in FIG. 3) bush section 151, and a lower bush section 152, which is connected to the bush section 151 via a widening transitional region, for receiving or inserting a contact pin 250 of the mating connector 200 (see also FIG. 5). Within each female contact 150 there is arranged a hollow-cylindrical contact spring 155 in the bush section 152, which for example has an opening diameter or contact diameter of 8 mm. The contact spring 155 has a plurality of resiliently formed, lamella-like contact regions, with the aid of which the contact pin 250 inserted into the relevant female contact 150 can be contacted.

An (electrical) connection between the female contacts 150 and the cores 301 of the lines 300 takes place with the aid of (two) separate connection elements 140, which are arranged within the housing 110 and are associated with the female contacts 150 or are connected thereto. Each of the two connection elements 140 has a crimped section 141 to which a core 301 of a line 300 can be fastened by crimping (indicated merely diagrammatically in FIG. 3). Adjoining or connected to the crimped section 141, each connection element 140 further has a bush section 142 in which a stepped bush section 151 of an associated female contact 150 can be received or inserted. Contacting of the female contact 150 takes place in this case via a hollow-cylindrical contact spring 145 arranged within the bush section 142 of the connection element 140 in question, which spring, like the contact spring 155 arranged within the female contact 150, has a plurality of resiliently formed, lamella-like contact regions (indicated in FIG. 3 by means of a lamella).

The use of the connection elements 140 offers the possibility of connecting a line 300 or the core 301 thereof in a simple manner (electrically) to one of the female contacts 150 of the plug-in connector 100. This applies in particular to the configuration shown here of the plug-in connector 100 with a cable outlet of 90°. In such case, the housing 110 of the plug-in connector 100 is pre-equipped with the connection elements 140, to which the cores 301 of the lines 300 are fastened by crimping, and the female contacts 150 (insertable via the open insertion side into the housing 110 or the housing section 112) are inserted into the bush sections 142 of the connection elements 140.

As is furthermore indicated in FIG. 3, each of the connection elements 140 is arranged within a housing part 132 made of a plastics material (also referred to as "insulation insert"). Such a housing part 132 is further surrounded by a housing-like metallic shield part 133 ("shield plate") provided for shielding. Corresponding to the two lines 300 which can be connected to the plug-in connector 100, the plug-in connector 100 comprises two such housing parts 132 which are encompassed by shield parts 133, which housing parts are inserted into the housing section 111 of the housing 110 or into the respective chambers of the housing section 111.

In such case, the housing and shield parts 132, 133 can be inserted via opening regions, on the rear side, of the housing section 111, on which also the lines 300 which are connected to the plug-in connector 100 are also brought out (not shown), into the housing section 111 or into the chambers provided here. In order to permit insertion of the female contacts 150 into the bush sections 142 of the connection elements 140, the housing section 111 is, or the chambers within the housing 110 are, opened towards the other housing section 112, and the housing parts 132 and the shield parts 133 have corresponding opening regions.

The shield parts 133 are further (electrically) connected to shielding means of the lines 300. To this end, the plug-in connector 100 comprises further components inserted into the housing section 111 or into the chambers thereof. These include for example crimp barrels which contact the shielding means of the lines 300, which encompass additional shield parts or shield plates (not shown) partially pushed on to the shield parts 132. Also, provision is made for the use of sealing elements or cable seals (not shown), which (likewise) are inserted into the housing section 111, and which surround the lines 300 or in each case a sheath of the lines 300 on the periphery.

Furthermore, the rear-side opening regions of the housing section 111 are closed with the aid of cap-like housing parts 131 arranged on the housing section 111 ("line caps"), as is illustrated in FIGS. 1 and 2. The housing parts 131 have corresponding openings for passing the lines 300 through. Also the housing parts 131 are provided with cutouts in which raised latch sections 113 arranged on the housing section 111 on the outside can engage for fixing the housing parts 131 (see FIG. 7).

As is furthermore illustrated in FIG. 3, the female contacts 150 inserted into the bush sections 142 of the connection elements 140 are surrounded by further components of the plug-in connector 100. Each of the female contacts 150 is encompassed in each case by an arrangement consisting of two housing parts 135, 136 which are arranged around one another and are substantially hollow-cylindrical or circular-cylindrical. The housing parts 135, 136 are constructed in each case from a plastics material, and like the female contacts 150 are inserted into the housing 110 via the accessible insertion side of the housing section 112. The cylindrical configuration of the housing parts 136 is apparent from FIG. 7.

The housing parts 135, which represent further "insulation inserts", as is illustrated in FIG. 3, adjoin the housing parts 132 encompassing the connection elements 140, or are latched thereto. The housing parts 136, which can be latched with the housing parts 135 and surround a front-side edge of the female contacts 150 or bush sections 152, serve for fastening the female contacts 150. The female contacts 150 in this case are held at a distance from the insertion side of the housing 110, the front-side edges of the female contacts 150 being covered by the housing parts 136. This means that the housing parts 136 simultaneously function as "finger protection", in order to prevent touching of the female contacts 150, which may be harmful to health, by a user.

Also in the region of the bush sections 152 of the female contacts 150, (two) metallic shield parts 137 ("shield plate") which are intended for shielding, are arranged within the housing 110. The shield parts 137, which have a substantially hollow-cylindrical or circular-cylindrical form and are (likewise) inserted into the housing 110 via the accessible insertion side of the housing section 112, encompass the housing parts 136 provided for fastening the female contacts 150. In this case, the shield parts 137 adjoin the shield parts 133 described above which are connected to the shielding means of the lines 300, and are therefore connected thereto in electrically conductive manner.

Figure 6:
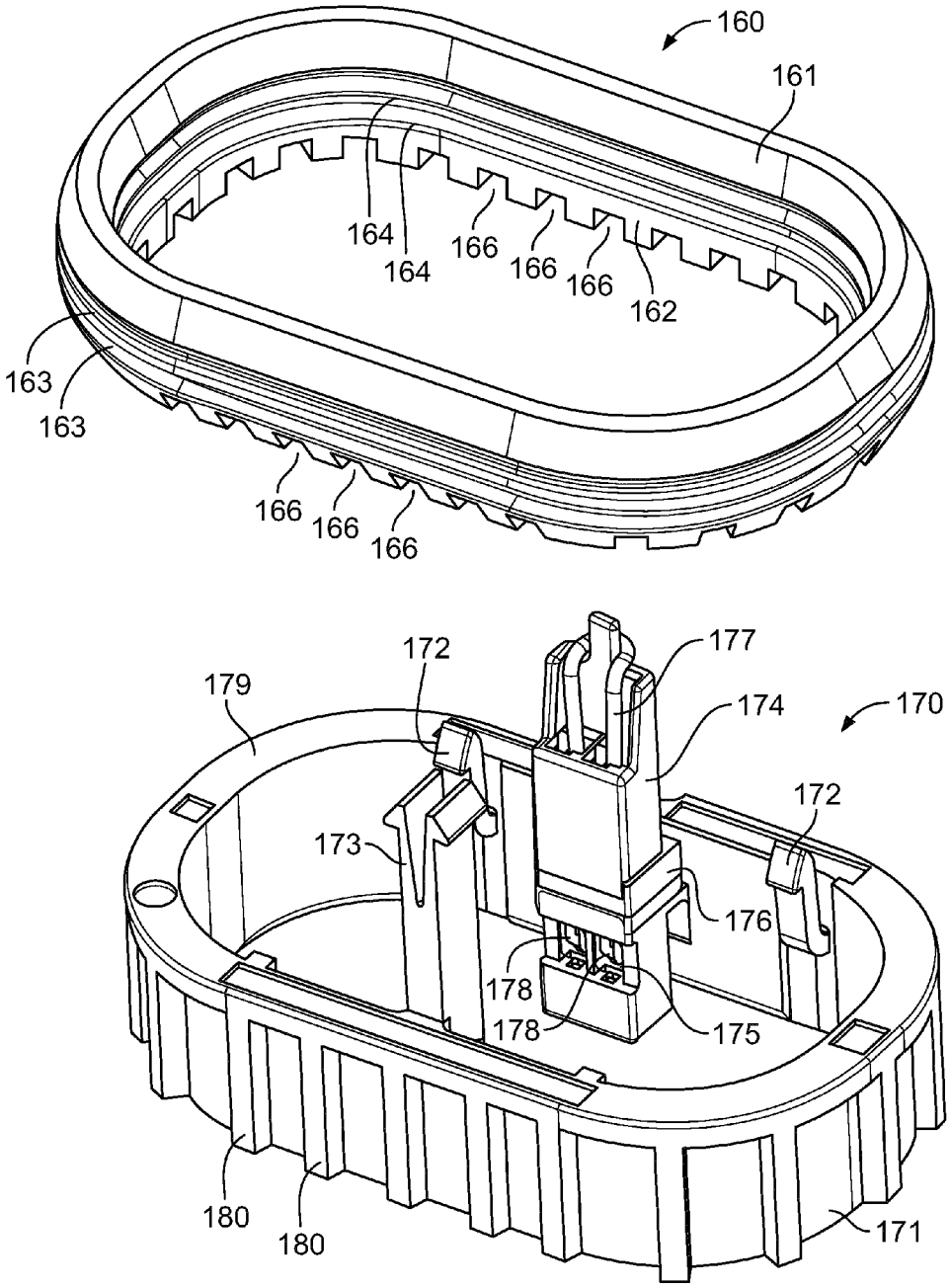
FIG. 6 shows a perspective view of a seal and a seal holder of the electrical connector.

As is further illustrated in FIG. 3, a seal 160 is provided within the housing 110 or the housing section 112 in the region of the bush sections 152 of the female contacts 150, which seal has a closed circumambient form. A perspective view of the (entire) seal 160 is shown in FIG. 6. In such case it becomes clear that the seal 160 in a top view has a form which corresponds to a rectangle with rounded-off corners, or a superellipse. The seal 160 which is inserted into the housing 110 via the open insertion side of the housing 110, as is indicated in FIG. 3, is arranged on a collar-shaped wall section 114, which encompasses the female contacts 150, (within) the housing 110, the wall section 114 lying opposite and spaced apart from of an outer wall of the housing 110 or of the housing section 112.

The seal 160, which is inexpensive to manufacture and comprises an elastic material (elastomer or rubber material), is used to seal off the plug-in connection between the connector 100 and mating connector 200. Furthermore, the seal 160 is also used to permit an elastic stop in the direction of plugging S of the plug-in connector 100 placed on the mating connector 200. These different functions of the seal 160, as will be described below in greater detail, are realised via different sections 161, 162 of the seal 160, which means that a high degree of reliability can be achieved.

The seal 160, as is apparent from FIG. 3, has an L-shaped cross-sectional profile with a first seal section 161 and a second seal section 162 extending perpendicular to the first seal section 161. In this case, the collar-shaped inner wall section 114 of the housing 110 is encompassed on its periphery by the first seal section 161 of the seal 160. The first seal section 161, which serves for sealing off the plug-in connection, is provided both on the inside and on the outside with sealing lips 163, 164. The second seal section 162, which is used in conjunction with the elastic stop of the plug-in connector 100, is in the form of an inward-directed flange, so the seal 160 can also be referred to as an "inverse L-seal". When the seal 160 is arranged on the wall section 114, the seal section 162 (partially) lies opposite a front side of the wall section 114 (downward-directed side in FIG. 3) or adjoins the front side of the wall section 114. Contrary to the illustration in FIG. 3, in which merely the cross-sectional form of the seal 160 is illustrated, the seal 160 does not project into the wall section 114, but is present in a (somewhat) deformed or compressed form on the wall section 114.

The plug-in connector 100 furthermore has within the housing 110 or the housing section 112 a seal holder 170 associated with the seal 160, as is illustrated in FIG. 3. The seal holder 170 is for example constructed from a plastics material, and can (likewise) be inserted into the housing 110 via the open insertion side of the housing 110. In such case, the seal holder 170 and the seal 160 (relative to the direction of plugging S of the plug-in connector 100) are arranged substantially one above the other.

The seal holder 170, in which a lower or in FIG. 3 downward-directed partial region is located in the region of the insertion side of the housing 110 or housing section 112, or which in the non-plugged state of the plug-in connector 100 protrudes out (somewhat) on the insertion side, is used both for fixing or holding the seal 160 against the wall section 114 and in conjunction with permitting the elastic stop of the plug-in connector 100. For the latter function, the seal holder 170 (relative to the direction of plugging S) is mounted axially displaceably against the housing 110 or within the housing section 112, in order to be able to be moved towards the seal 160 upon the connection operation of the connector 100 and mating connector 200 and to be able to be pressed against the seal 160. Such mobility of the seal holder 170 is realised in a relatively simple manner. The interplay of the seal holder 170 and seal 160 upon the connection operation of the connector 100 and mating connector 200 will be discussed in greater detail further below.

A perspective view of the (entire) seal holder 170 is shown in FIG. 6. Therein, it is clear that the seal holder 170 has a collar-shaped base part 171. The base part 171 has a closed circumambient form which is matched to the seal 160, and which (likewise in a top view) corresponds to a rectangle with rounded-off corners or a superellipse. On an upper side of the base part 171 of the seal holder 170 there is provided an outward-directed, circumambient flange 179. In the state when the seal holder 170 is arranged on the housing 110 of the plug-in connector 100, the flange 179 lies opposite the seal section 162 of the seal 160, or adjoins the flange 179 on the seal section 162 (see FIG. 3). The adjoining or lying of the flange 179 of the seal holder 170 against the seal section 162 of the seal 160 occurs in particular upon the connection operation and in the plugged state of the connector 100 and mating connector 200, and may (already) be present in the non-plugged state of the plug-in connector 100 as well.

As is further illustrated in FIG. 6, the collar-shaped base part 171 of the seal holder 170 is provided on an outer side with ribs 180 adjoining the flange 179. These serve to impart greater stability to the seal holder 170.

Furthermore, the seal holder 170 has hook-shaped latch elements 172, 173 which are formed on an inner side of the collar-shaped base part 171, and which (partially) project across the flange 179. The latch elements 172, 173 make it possible to latch the seal holder 170 on or in the housing 110 or housing section 112 of the plug-in connector 100, which prevents the seal holder 170 from detaching from the housing 110 of the (non-plugged) plug-in connector 100.

As is illustrated in FIG. 6, the seal holder 170 has on a long side two latch elements 172 which are arranged spaced apart from each other, which are in the form of latch hooks. On an opposing long side, the seal holder 170 has an individual latch element 173 which has a greater length or height than the other two latch elements 172. The latch element 173 is in the form of a bar-shaped section which is connected to the base part 171 of the seal holder 170, the end of which section is provided with two latch hooks which are formed mirror-symmetrically to each other. In the state of the seal holder 170 when it is arranged in or on the housing 110 of the plug-in connector 100, the latch hooks or latch elements 172, 173 engage in cutouts which are formed on the housing 110 (or on corresponding wall or inner-wall sections), so that detachment of the seal holder 170 is suppressed.

This is illustrated in the sectional view of FIG. 3 for one of the two (small) latch elements 172. In that case, the latch element 172 engages in a cutout in a wall section of the housing 110 or the housing section 112 which lies opposite the wall section 114 against which the seal 160 is arranged, on the inside and spaced apart therefrom. Also one of the shield parts 137 is latched on this cutout, as becomes apparent with reference to FIG. 3.

The cutouts of the housing 110 which are associated with the latch elements 172, 173 are formed such, or have such dimensions, that the latch elements 172, 173 and hence the seal holder 170 have a corresponding freedom of movement which is axial with regard to the direction of plugging S. With regard to the mobility or displaceability of the seal holder, further, guidance of the seal holder 170 can be brought about via the latch elements 172, 173 of the seal holder 170 which are arranged in opposition and also corresponding regions or wall sections of the housing 110 along which the seal holder 170 is moved upon displacement.

Figure 4:
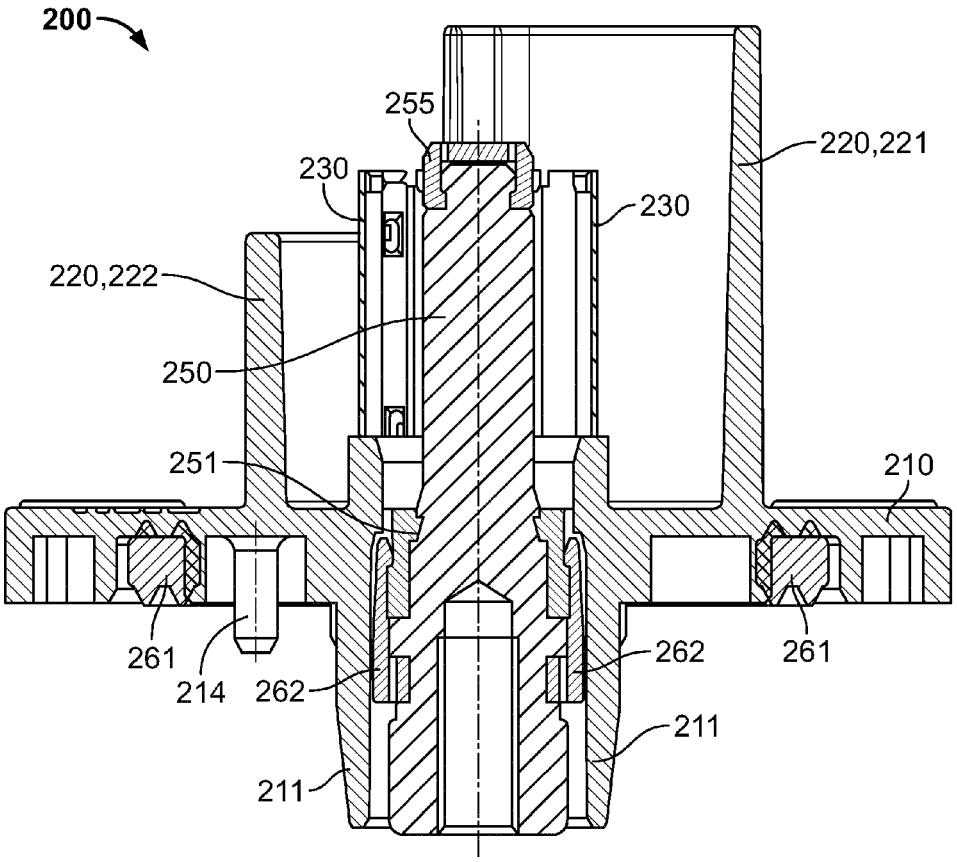
FIG. 4 shows a sectional view of the mating connector.

FIG. 4 shows a sectional view of the mating connector 200, by means of which (further) details of the mating connector 200 become apparent. The contact pins 250 which are encompassed by the collar 220, of which merely one contact pin 250 is illustrated in cross-section in FIG. 4, are arranged in each case with a lower partial section in one of the hollow-cylindrical holding sections 211. In this region, each contact pin 250 is provided with an annular groove 251 into which a partial region of a holding section 211 engages for fixing the appropriate contact pin 250.

Furthermore, the contact pins 250 which are received in the holding sections 211 are additionally surrounded by further securing elements 262, which likewise are arranged within the holding sections 211, and which serve as "second contact lock means" of the contact pins 250. The securing elements 262 have at an (upper) end raised latch sections which engage around stepped regions of the holding sections 211. At an opposing (lower) end, further raised sections are formed which engage in cutouts formed on the contact pins 250.

The contact pins 250 which are received in the holding sections 211 furthermore have upper partial sections protruding out of the holding sections 211, which upper partial sections in the plugged state of the connector 100 and mating connector 200 are (partially) inserted into the female contacts 150 of the plug-in connector 100 or into the bush sections 152 thereof (see FIG. 5). These partial sections of the contact pins 250, which may also be referred to as "contacting sections", may have a contact diameter of for example 8 mm, corresponding to the female contacts 150.

As further becomes clear with reference to FIG. 4, the contact pins 250 are provided in each case with a protective cap 255 on an upper side. The protective caps 255 which are formed from a plastics material act as "finger protection", in order to prevent touching of the upper side of the contact pins 250, which are otherwise constructed from a metallic material, by a user, which may be harmful to health.

Direct touching of a contact pin 250 or of a contacting section of a contact pin 250 protruding from a holding section 211 is furthermore prevented with the aid of metallic shield parts 230 provided on the mating connector 200. The shield parts 230 are substantially hollow-cylindrical or circular-cylindrical, and encompass the contact pins 250 (see FIG. 8). On a (lower) end, the shield parts 230 are provided with strip-shaped fastening sections 231 (see FIGS. 1 and 7), with the aid of which the shield parts 230 are fastened to the mating connector 200. For this, corresponding cutouts are provided on the base part 210 of the mating connector 200 in the region of the holding sections 211, through which cutouts the strip-shaped fastening sections 231 are inserted.

The mating connector 200 furthermore has a circumambient seal 261 arranged on an underside of the base part 210 (see FIGS. 4 and 7), with the aid of which sealing of the mating connector 200 which is screwed to a device can be brought about. Also, the mating connector 200 has raised sections 214 which are formed on the base part 210 and extend beyond the underside, with the aid of which raised sections "coding" of the mating connector 200 can be realised, in order for example to be able to screw the mating connector 200 only to certain devices (with cutouts associated with the raised sections 214) and/or in a predetermined orientation onto a device.

FIG. 5 shows a sectional view of a partial region of the plug-in connector 100 and the mating connector 200 in the plugged state, an (upper-side) part of the mating connector 200 being received in the housing 110 or housing section 112 of the plug-in connector 100. In this case, the collar 220 with the collar sections 221, 222 of the mating connector 200 is arranged in a corresponding hole which adjoins the outer wall of the housing section 112. The circumambient collar 220 in this case presses against the outer side or against the outer-side sealing lips 163 of the circumambient sealing section 161 of the seal 160 which is arranged with the inner side or with the inner-side sealing lips 164 on the circumambient wall section 114, and as a result is compressed inwards or (relative to the direction of plugging S) radially. In this manner, the plug-in connection produced via the connector 100 and mating connector 200 is reliably sealed at this point. In such case, it is pointed out that, corresponding to FIG. 3, in FIG. 5 too the seal 160 does not project into the wall section 114 and into the collar sections 221, 222 of the collar 220, but merely the (non-compressed) cross-sectional profile of the seal 160 is illustrated.

In the plugged state of the connector 100 and mating connector 200, furthermore the contact pins 250 of the mating connector 200 or the partial or contacting sections which protrude out of the holding sections 211 are received in the bush sections 152 of the female contacts 150, which means that these contact elements 150, 250 are contacted electrically with each other. In such case, the contact pins 250 are further encompassed by the contact springs 155 provided in the female contacts 150. In this manner, the contact pins 250 of the mating connector 200 are electrically connected via the female contacts 150 and the connection elements 140 of the plug-in connector 100 to the cores 301 of the lines 300 connected to the plug-in connector 100.

In the plugged state, furthermore also the shield parts 230 of the mating connector 200 are encompassed by the shield parts 137 of the plug-in connector 100 and are contacted thereby. This means that the shield parts 230 of the mating connector 200 are electrically connected (via the shield parts 137, 133 and the further shield parts and crimp barrels described above) to the shielding means of the lines 300 connected to the plug-in connector 100.

Upon the connection operation of the connector 100 and mating connector 200, the seal holder 170 which is mounted movably on the plug-in connector 100 and protrudes on the insertion side of the plug-in connector 100 from a certain insertion depth onwards or at the end of the connection operation is pressed against the mating connector 200, i.e. against the plate-shaped base part 210 or the upper side thereof, which moves the seal holder 170 counter to the direction of plugging S into the housing 110 of the plug-in connector 100, and towards the seal 160. In so doing, the seal holder 170 which lies against the seal 160 presses with the flange 179 against the seal section 162 of the seal 160. This results in the seal section 162 of the seal 160 being pressed against the front side (directed downwards in FIG. 5) of the collar-shaped wall section 114 of the housing 110, and the seal section 162 as a result being compressed or squeezed axially (relative to the direction of plugging S). The seal 160 which is "pre-tensioned" in this manner, together with the movable seal holder 170, permits a (circumambient) elastic stop of the plug-in connector 100 on the mating connector 200. This means that a manufacturing-related or tolerance-related play of the plug-in connector 100 which is placed on the mating connector 200 can be reduced or eliminated, which makes the plug-in connection less sensitive or more robust to mechanical influences such as in particular vibrations.

In the plugged state of the connector 100 and mating connector 200, the housing section 112 of the housing 110 of the plug-in connector 100 or an edge of the outer wall thereof may lie against the base part 210 of the mating connector 200. Alternatively, it is also possible for these constituents 112, 210 to be arranged at a (short) distance from each other.

As is furthermore illustrated in FIG. 6, the seal 160 or the seal section 162 is provided with cutouts 166 on the side against which the seal holder 170 with the flange 179 presses upon the connection operation and in the plugged state of the connector 100 and mating connector 200. In this manner, additional transverse compression of the partial regions of the seal 160 located between the cutouts 166 is permitted. This means that greater elasticity can be made available in this region for the seal 160, and hence for the elastic stop realised via the seal 160 and seal holder 170. This provides the possibility of facilitating compression of the seal 160 upon the connection operation, and hence the carrying-out of the connection operation. Also, optionally a play of the plug-in connector 100 placed on the mating connector 200 can be (still) better reduced.

In the connector system, furthermore provision is made for the use of what is called a short-circuit bridge, also referred to as "interlock system". For the short-circuit bridge, the seal holder 170, as illustrated in FIG. 6, has a housing-like holding section 174 which is arranged on the inner side of the base part 171 of the seal holder 170 or is connected to the inner side of the base part 171 via a connecting bar.

The short-circuit bridge provided on the holding section 174 comprises a line 177 which is guided around in a U-shape around a ridge-shaped raised section on an upper (in FIG. 6)

end of the holding section 174, and the ends of which are connected to contact elements 178 inserted into the holding section 174. The contact elements 178 are female contacts 178, for example "MOON" female contacts ("multi-contact") with a contact diameter of for example 1.2 mm. The female contacts 178 are provided with latch springs which can engage in an opening 175 ("latch window") formed on the holding section 174, so that the female contacts 178 are latched to the holding section 174. For additional fixing of the female contacts 178, further a securing element 176 which engages around the holding section 174 is arranged on the holding section 174, which element serves as a "second contact lock means" of the female contacts 178. The securing element 176 can engage in a cutout formed on the holding section and in corresponding cutouts provided on the female contacts 178, provided that the female contacts 178 are in the installed position provided for them on the holding section 174.

Figure 7:
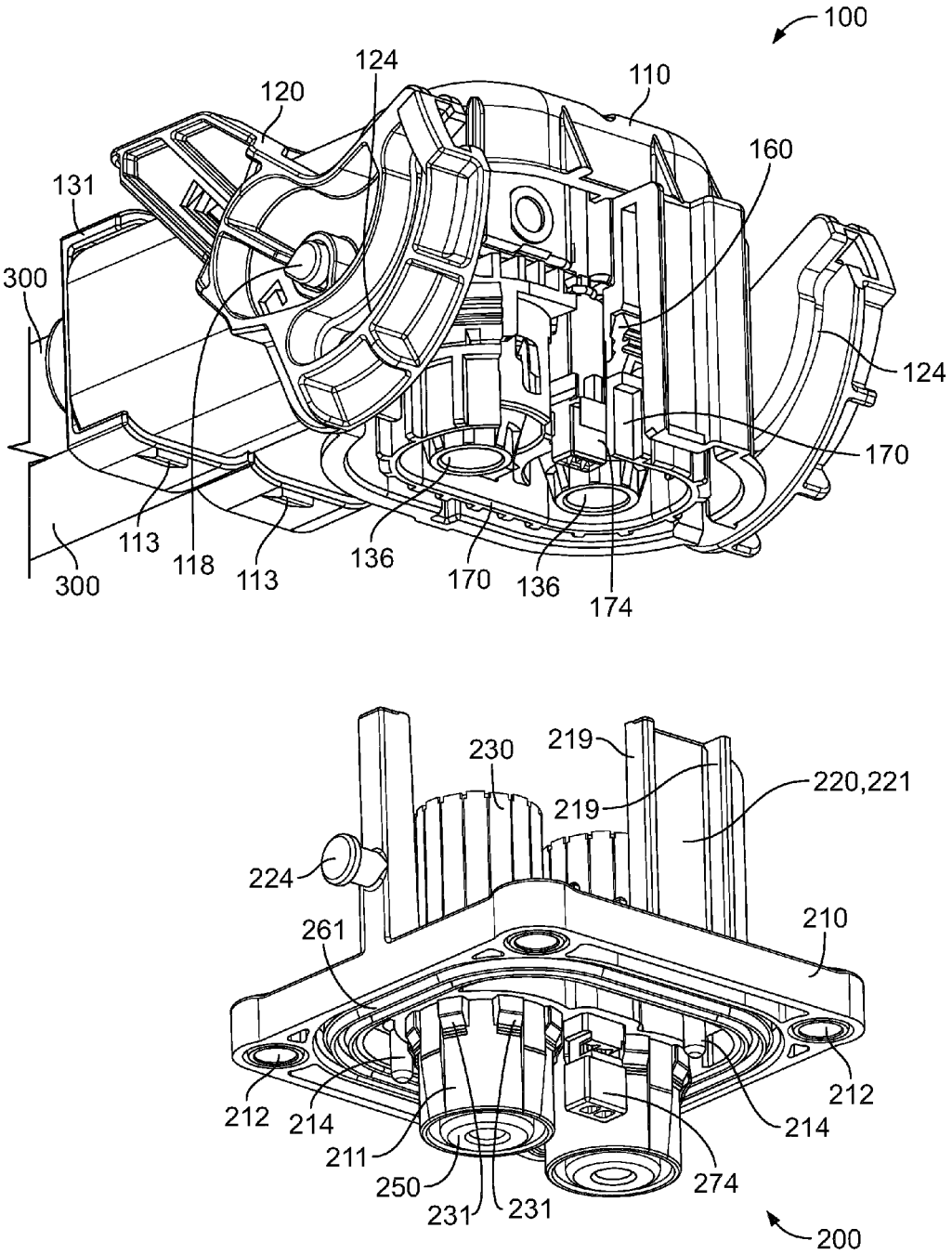
FIGS. 7 and 8 show further perspective and partially sectioned views of the electrical connector and the mating connector in the non-plugged state.
Figure 8:
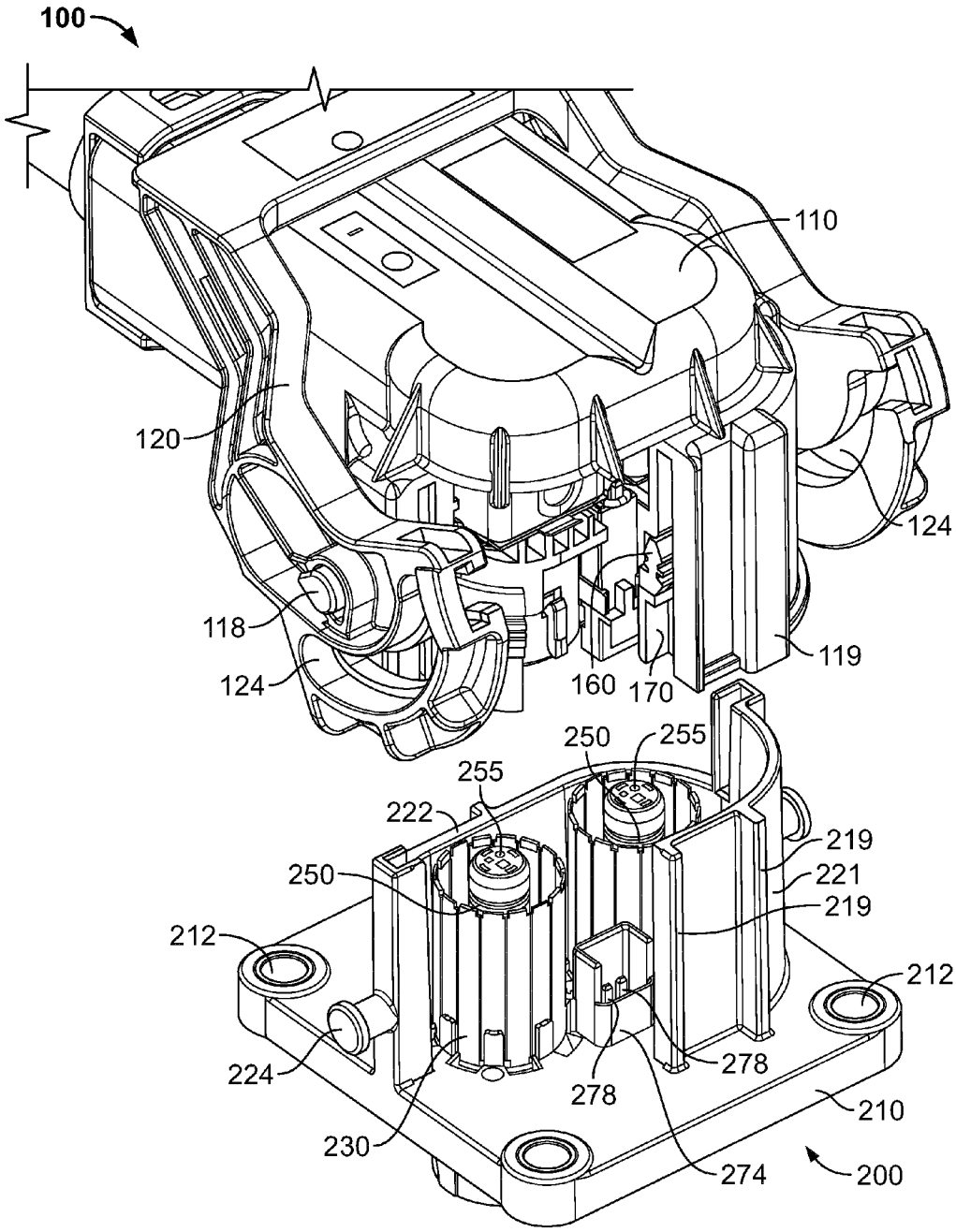

As is illustrated in FIGS. 7 and 8, corresponding to this a corresponding, housing-like holding section 274 is provided on the mating connector 200 or on the base part 210 thereof. In the holding section 274 there are arranged contact pins 278 which are complementary to the female contacts 178, which pins for example corresponding to the female contacts 178 may have a contact diameter of 1.2 mm. Upon the connection operation of the connector 100 and mating connector 200, the holding section 174 of the seal holder 170 of the plug-in connector 100 is inserted into the holding section 274 of the mating connector 200, and as a result the contact pins 278 are inserted into the female contacts 178, which short-circuits the contact pins 278. Based on this, it can be established reliably whether the plug-in connector 100 is placed on the mating connector 200 or not.

The embodiments of the plug-in connector 100 and the mating connector 200 discussed with reference to the figures represent preferred embodiments, or embodiments by way of example, of the invention. In addition to the embodiments which have been described and illustrated, further embodiments which may comprise further modifications or combinations of features are conceivable. In particular, other materials and dimensions than those stated, and differently constructed components (for example housing 110, contact elements 150, 250, etc.), may be provided.

In this respect, for example also configurations of a plug-in connector 100 with a construction comparable to the plug-in connector 100 described above may be considered, to which instead of two lines 300 three such lines 300 can be connected, and which therefore comprise three female contacts 150. A mating connector 200 which corresponds thereto may have a construction comparable to the mating connector 200 described above and comprise three contact pins 250.

Furthermore, it is conceivable to equip a plug-in connector 100 with contact pins 250, and a corresponding mating connector 200 with female contacts 150. This is also possible with regard to a short-circuit bridge, with a plug-in connector 100 provided with the short-circuit bridge possibly comprising contact pins 278, and the mating connector 200, associated female contacts 178. A short-circuit bridge may alternatively also be provided on the mating connector 200, or alternatively omitted.

One further possible modification is a plug-in connector 100 in which a section of a line 300 connected to the plug-in connector 100 in the region of the plug-in connector 100 extends at an angle which differs from a right-angle to a direction of plugging of the plug-in connector 100, i.e. a cable outlet which differs from 90° is present.

With regard to a seal 160 used for sealing and for permitting an elastic stop on a plug-in connector 100, there is for example the possibility of providing a cross-sectional profile which deviates from an L-shaped cross-sectional profile. One possible example is a circumambient, closed seal with a rectangular cross-sectional profile which is arranged on a circumambient step-shaped section of a plug-in connector 100 and is radially compressed for sealing (relative to a direction of plugging), and is axially compressed for the elastic stop (relative to the direction of plugging).

Modifications are also possible with regard to a movably mounted seal holder 170. For example, a seal holder may have different numbers and/or differently constructed latch elements which differ from the latch elements 172, 173 shown. Instead of arranging a seal holder 170 displaceably on a plug-in connector or a housing thereof, also a different mobility of the seal holder 170 which cooperates with a seal 160 or lies against a seal 160 can be provided. One example is a rotatably or pivotably mounted seal holder which upon a connection operation of the connector 100 and mating connector 200 is pressed against the mating connector 200, and as a result is pivoted in the direction of a seal arranged on the plug-in connector 100 and in so doing is pressed against the seal. For this, corresponding articulation or hinge structures may be provided on the plug-in connector 100 and the seal holder.

A (further) possible modification of a mating connector 200 consists for example in providing one or more raised stop structures on an upper side of a base part 210, against which structures a movable seal holder of a plug-in connector 100 can be pressed upon the connection operation. With such a configuration, there is further the possibility of forming the plug-in connector 100 with the seal holder such that the seal holder arranged on the plug-in connector 100 or in a housing of the plug-in connector 100 (in the non-plugged state) does not protrude out of the housing, but is arranged within the housing at a distance from an insertion side of the housing.

For a mating connector 200 it may further be considered to form a base part 210 with a collar 220 formed thereon made from a metallic material (for example aluminium). With such a configuration, for the mating connector 200 further an insert which is formed from a plastics material and which can be received in the base part may be considered, which insert comprises corresponding holding sections (comparably to the holding sections 211 described above) for contact elements or female contacts 250, and (optionally) a holding section (comparably to the holding section 274 described above) for contact elements or contact pins 278 for contacting a short-circuit bridge.

Furthermore, the plug-in connector 100 described and the mating connector 200 and also modifications thereof may comprise further structures and components which are not shown or not described or also attachable. These include for example cable terminals which can be connected to the contact pins 250 of the mating connector 200, contact elements which can be connected to the shield parts 230 of the mating connector 200, etc.

Furthermore, it is pointed out that the connector system described here and modifications thereof is/are not restricted only to the fields of use described above (hybrid, battery and/or fuel-cell vehicles), but also can be used in other fields of use.

The invention claimed is:

1. An electrical connector for producing a plug-in connection with a mating connector, the electrical connector comprising: a housing, a seal arranged on the housing, and a seal holder arranged on the housing and associated with the seal, wherein the seal holder is arranged movably on the housing, to be moved in the direction of the seal and to be pressed against the seal upon mating.

2. The electrical connector according to claim 1, wherein the seal holder is arranged displaceably on the housing.

3. The electrical connector according to claim 1, wherein the seal holder has a latch element which engages in a cutout of the housing.

4. The electrical connector according to claim 1, wherein the seal holder has a short-circuit bridge which is contacted by the mating connector upon mating.

5. The electrical connector according to claim 1, wherein the seal has a closed circumambient form and is arranged on a collar-shaped wall section of the housing.

6. The electrical connector according to claim 1, wherein the seal has an L-shaped cross-sectional profile with a first seal section and a second seal section extending perpendicular to the first seal section.

7. The electrical connector according to claim 6, wherein the first seal section encompasses a collar-shaped wall section of the housing on its periphery, the second seal section is in the form of an inward-directed flange, and the seal holder is arranged movably on the housing such that the second seal section is pressed against a front side of the collar-shaped wall section upon a movement of the seal holder.

8. The electrical connector according to claim 1, further comprising: a contact element for producing an electrical connection with a complementary contact element of the mating connector, and a connection element which is separate from the contact element and connected to the contact element for producing an electrical connection with a line.

9. The electrical connector according to claim 1, wherein a line connected to the electrical connector extends at a right-angle to a mating direction.

10. A connector system comprising an electrical connector according to claim 1 and a mating connector which can be mated with the electrical connector.

11. The connector system according to claim 10, wherein the mating connector has a collar-shaped section receivable in the housing of the electrical connector, and the seal of the electrical connector is arranged on the housing such that the collar-shaped section encompasses the seal of the electrical connector and is in physical contact with the seal upon mating.

12. The connector system according to claim 11, wherein the collar-shaped section of the mating connector comprises two partial sections of different heights.

* * * * *

UNITED STATES PATENT AND TRADEMARK OFFICE

CERTIFICATE OF CORRECTION

PATENT NO. : 9,166,329 B2
APPLICATION NO. : 13/985641
DATED : October 20, 2015
INVENTOR(S) : Eckel et al.

It is certified that error appears in the above-identified patent and that said Letters Patent is hereby corrected as shown below:

In the claims

Column 15, Line 7, claim 3 “in” should be deleted.

Signed and Sealed this
Fifth Day of April, 2016

Michelle K. Lee

Michelle K. Lee
*Director of the United States Patent and Trademark Office*